US006453624B1

(12) United States Patent
Hoffman

(10) Patent No.: US 6,453,624 B1
(45) Date of Patent: Sep. 24, 2002

(54) PLAYSET TOWER ASSEMBLY ARRANGEMENT

(75) Inventor: Donald E. Hoffman, Wayland, MA (US)

(73) Assignee: Creative Playthings, Ltd., Framingham, MA (US)

( * ) Notice: Subject to any disclaimer, the term of this patent is extended or adjusted under 35 U.S.C. 154(b) by 0 days.

(21) Appl. No.: 09/515,111

(22) Filed: Feb. 29, 2000

(51) Int. Cl.[7] ..... E04H 1/12; E04H 15/00; E04B 1/00

(52) U.S. Cl. ..... 52/63; 52/79.4; 52/82

(58) Field of Search ..... 52/82, 79.1, 79.4, 52/79.6, 263, 63; 472/116, 136, 137; D25/13, 16, 17, 18, 19, 31, 32

(56) References Cited

U.S. PATENT DOCUMENTS 1,985,789 A * 12/1934 Lightfoot ..... D25/32
4,173,855 A * 11/1979 Raptoplous ..... 52/82
4,335,558 A * 6/1982 Caldwell et al. ..... 52/82
4,509,302 A * 4/1985 Donatelli ..... 52/82
4,739,594 A * 4/1988 Langford et al. ..... 52/82
5,029,420 A * 7/1991 Goto ..... 52/82
5,383,313 A * 1/1995 Deeke et al. ..... 52/82
D366,086 S * 1/1996 Ziegler, Jr. et al. ..... D21/826
5,528,875 A * 6/1996 Ziegler, Jr. et al. ..... 52/702

* cited by examiner

*Primary Examiner*—Michael Safavi
(74) *Attorney, Agent, or Firm*—Don Halgren

(57) ABSTRACT

A playset tower assembly for young children to climb upon and in, while minimizing potential areas of injury and maximizing structural stability. The assembly includes an array of six corner posts having an upper and a lower end, with front and side facing surfaces thereon, and an arrangement of lower, intermediate and upper side beams connectively arranged therewith. Each of the beams have ends with mitered surfaces thereon to flushly engage their respective side facing surfaces of the six corner posts. Angled brackets are arranged for securing said beams to the six corner posts, the brackets being angled to minimize any spaces between said beams and said corner posts.

18 Claims, 6 Drawing Sheets

PLAYSET TOWER ASSEMBLY ARRANGEMENT

BACKGROUND OF THE INVENTION

1. Field of the Invention

This invention relates to a child's wooden playset construction, and more particularly to a playset tower arrangement having construction features that make it easy to assemble and safe for young children to use.

2. Prior Art

The childrens' playsets and swing equipment are elements of construction where attention to detail, for safety reasons, is vitally important. This is so, because the users of this equipment, children, don't necessarily know how to play around these things properly, and unsafe design and construction may mean an injured child. Such children may run, climb and jump from such a construction without regard to safety, or where they may place their hands or fingers, or where their may fall when doing so. Such places of dangers may be found between the horizontal wall supports and the vertical corner posts, unless those supports and posts are secured together properly using angled or mitered cuts.

U.S. Pat. No. 5,528,875 to Ziegler, Jr. et al. shows a wood play tower kit with structures or wall supports with a straight cuts thereon. Such straight end cuts leave openings at the vertical corner posts and the associated brackets, for little fingers to go into.

It is an object of the present invention to provide an improved play assembly over that shown in the prior art.

It is yet a further object of the present invention, to provide a kit which is readily assemblyable, while providing the required safety considerations for those who will use this assembled construction.

It is yet a still further object of the present invention, to provide a wooden play assembly, having brackets which facilitate the construction and accommodate the safety concerns necessarily required for the children who will use such an apparatus.

It is still yet a further object of the present invention, to provide a play tower assembly which utilizes brackets which are less complicated than those found in the prior art those making assembly less complicated and less expensive while making such assembly safer for the end user.

BRIEF SUMMARY OF THE INVENTION

The present invention comprises a child's playset tower construction assembly or kit for making such playset tower assembly or gazebo. The playset tower assembly comprises six corner posts arranged in a hexagonal pattern to define the outer perimeter of the playset tower assembly. An elongated side support board is arranged between adjacent corner posts, at ground level. Each side support is pre-mitered at a 30 degree angle, at each end thereof, so the end face of each side support board is flush with the corresponding side of its contiguous corner post.

An intermediate side support board is arranged between adjacent corner posts, the intermediate side support boards having mitered ends cut at an angle of 30 degrees, so as to have their end portions flush with the respective side walls of the vertical posts, with no gaps or spaces therebetween. The lower side support boards and the intermediate side support boards are attached to the respective corner posts, by an angle brace or bracket.

Each bracket is designed so as to be flush with the respective surface to which it attaches, so as not to leave any openings where a child might get hurt. Each bracket comprises an elongated plate having a first end and a second end and an intermediate portion. The first end and the second ends are bent at an angle of 30 degrees with respect to the plane of the intermediate portion. An upper support beam is arranged at an upper location between adjacent corner posts, each upper support board having mitered cuts at their respective ends, so as to present a flat face against its respective mating surface of the corner support post to which it is attached. The upper support boards are attached to the corner posts by an angled bracket, in a manner similar to that of the aforementioned lower side support boards.

An uppermost side support board or rail is attached to the uppermost portions of the corner posts each uppermost support rail having a 30 degree mitered end thereon, so as to provide a flush pre-cut mitered surface to mate flat with the uppermost end of the corner post. An uppermost brace or bracket is arranged at the uppermost end of each corner post, to secure the mitered ends of the uppermost wall supports or rails to that respective corner post.

By virtue of having the side support boards or rails pre-cut or mitered by the manufacturer of this kit, permits this playset tower construction in which children climb, to be assembled much faster and in a safer manner for the children for whom it is intended than that shown in the tower playset prior art. The unique combination of the angled braces or brackets attaching this child's playset tower in a safe configuration avoiding openings for places where little childrens' fingers or items of clothing or hair could be caught resulting in injury to that child.

The top angled brace or bracket as an intermediate portion with an outwardly directed pocket thereon. A curved tent pole which extends to arc of about 90 degrees, has a lowermost end which mates within that pocket of the top angled brace. A curved tent pole is placed in each pocket at each top brace at each upper end of the respective corner posts. Each curved tent pole has an uppermost end which is attachable to a tent top plate. The curved tent poles, once attached to one another through the tent top plate comprise the ribs for a hexagon canvas tent to be placed thereover.

A plurality of floor slats are arranged across the intermediate side supports, and a plurality of side wall members are secured between the intermediate wall supports and the upper wall supports. The child's play area is entered through a wall opening between adjacent corner posts above the intermediate side support boards or beams. A ladder is typically used to gain entry through that side opening therein.

Thus, what has been shown is a unique play set tower assembly, which comes in disassembled kit form, having a unique composition of components to minimize injury to children and to facilitate ease of construction of a playset tower assembly in a "multiple child-height" tower.

The invention thus comprises a playset tower assembly for young children to climb upon and in, while minimizing potential areas of injury and maximizing structural stability, comprising: an array of six corner posts having an upper and a lower end, and front and side facing surfaces; an arrangement of lower, intermediate and upper side beams, each of the beams having ends with mitered surfaces thereon to flushly engage their respective side facing surfaces of the six corner posts; and an arrangement of angled brackets for securing the beams to the six corner posts, the brackets angled to minimize any spaced between the beams and the corner posts. The side beams are mitered at an angle of thirty degrees to as to provide a flush mating surface between the side beams and the side facing surfaces of the six corner posts. The side brackets have side portions and an intermediate portion which are formed at an angle of thirty degrees with respect to one another. The tower assemble includes an uppermost beam arranged between the uppermost ends of the six corner posts and attached thereto by a top bracket, the top bracket having an enlarged receiving pocket thereon, for securement of a top arrangement to the assembly. The top arrangement includes a plurality of curved tent poles. The curved tent poles have a lower end which mate with the receiving pockets in the side brackets. The curved tent poles have an upper end which attaches with a tent plate for stability of the poles. A tent may be arranged over the tent poles, to provide a safe enclosure for young children playing within the tower assembly. The beams, six corner posts, brackets, curved poles and tent are preferably a kit for assembly by a purchaser thereof. The assembly comprises a structure of between 4 and 8 feet in height. The invention also includes a method of constructing a playset tower assembly for the safe use of young children, comprising the steps of: arranging a vertical array of six corner posts in a hexagonal pattern, the posts having an upper and a lower end, and front and side facing surfaces; providing an arrangement of lower, intermediate and upper side beams between adjacent corner posts, each of the beams having ends with mitered surfaces thereon to flushly engage their respective side facing surfaces of the six corner posts; and securing an arrangement of angled brackets to the beams and to the six corner posts, the brackets angled to minimize any spaced between the beams and the corner posts for safety of any children playing within the tower assembly. The method includes the steps of: pre-mitering the beams at an angle of thirty degrees to as to provide a flush mating surface between the side beams and the side facing surfaces of the six corner posts; arranging a plurality of curved tent poles on the upper end of the corner posts; mating a lower end of the curved tent in a receiving pocket in the side brackets on the upper end of the corner posts; securing an upper end of the tent poles to a tent plate for stability of the poles; placing a tent arranged over the tent poles, to provide a safe enclosure for young children playing within the tower assembly.

BRIEF DESCRIPTION OF THE DRAWING

The objects and advantages of the present invention will become more apparent, when viewed in conjunction with the following drawings in which.

DESCRIPTION OF THE PREFERRED EMBODIMENTS

Figure 1:
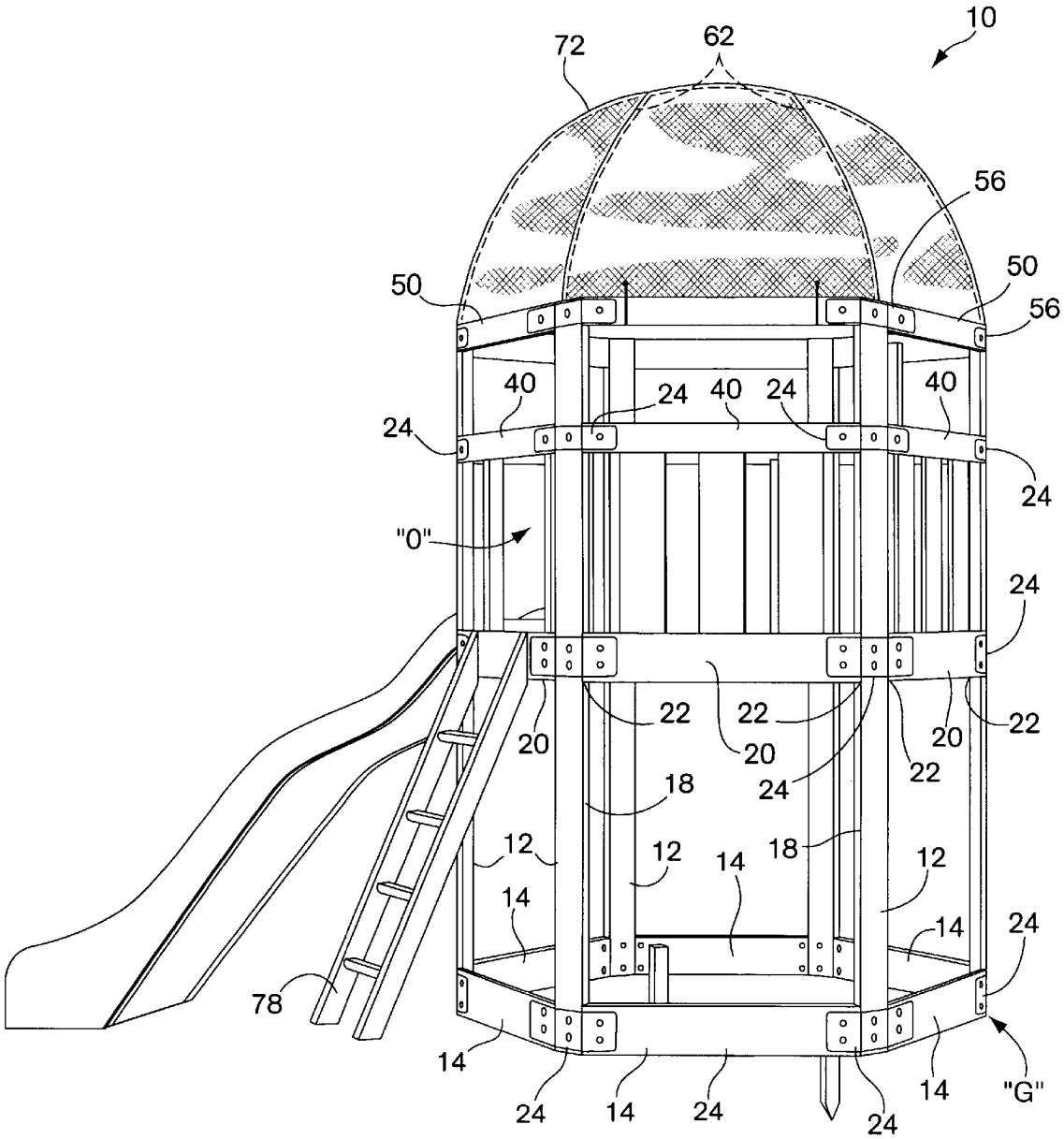
FIG. 1 is a side view of a playset tower assembly constructed according to the principles of the present invention.
Figure 2:
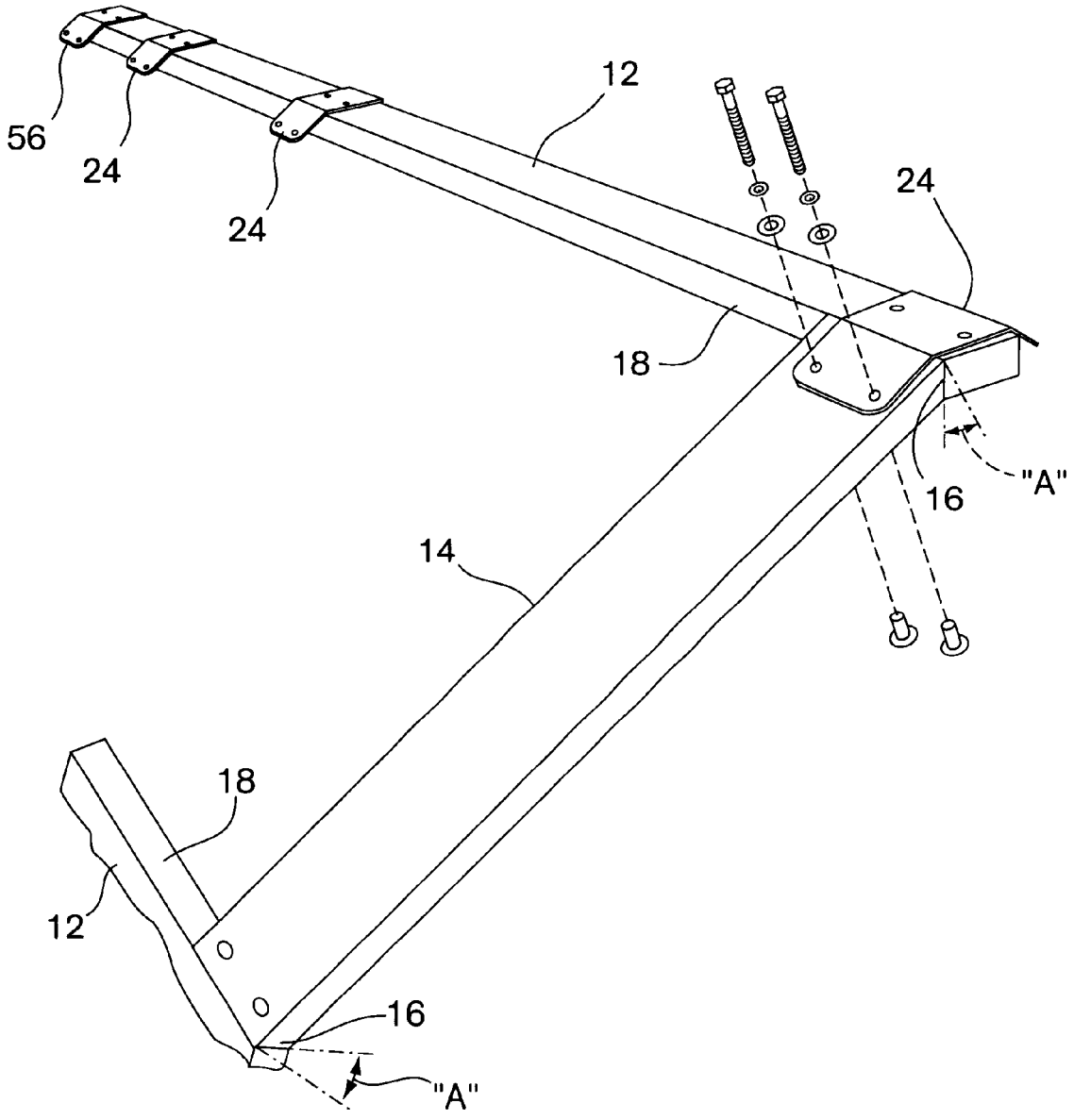
FIG. 2 is a perspective view of a corner post and side support rail of the kit according to the present invention.

Referring now to the drawings in detail, and particularly to FIG. 1, there is shown the present invention which comprises a child's playset tower construction assembly, or kit for making such playset tower assembly or gazebo 10. The playset tower assembly 10 comprises six corner posts 12 of a height a multiple of a child's, arranged in a hexagonal pattern "H" for maximum stability, to define the outer perimeter of the playset tower assembly 10. An elongated side support board 14 is arranged between adjacent corner posts 12, at ground level "G". Each side support 14 is mitered at a 30 degree angle "A", at each end thereof, so the end face 16 of each side support board 14 is flush with the corresponding side 18 of its contiguous corner post 12, as best shown in FIG. 2.

An intermediate side support board 20 is arranged between adjacent corner posts, as shown in FIG. 1, the intermediate side support boards 20 having mitered ends 22 also cut at an angle of 30 degrees, similar to those of the side supports 14, so as to have their ends 22 flush with the respective side walls 18 of the vertical corner posts 12, with no gaps or spaces therebetween. The lower side support boards 14 and the intermediate side support boards 20 are attached to the respective corner posts, by an angle brace or bracket 24, as shown in FIGS. 1–4.

Figure 3:
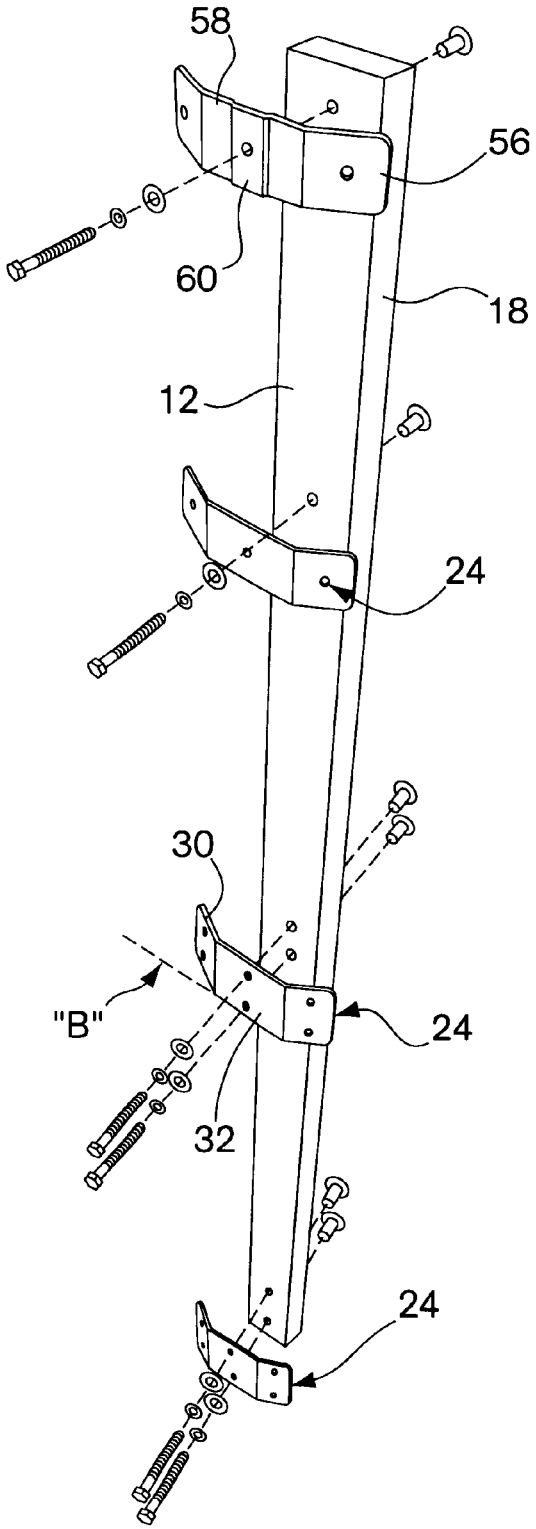
FIG. 3 is a perspective view of a corner post and braces thereon.
Figure 4:
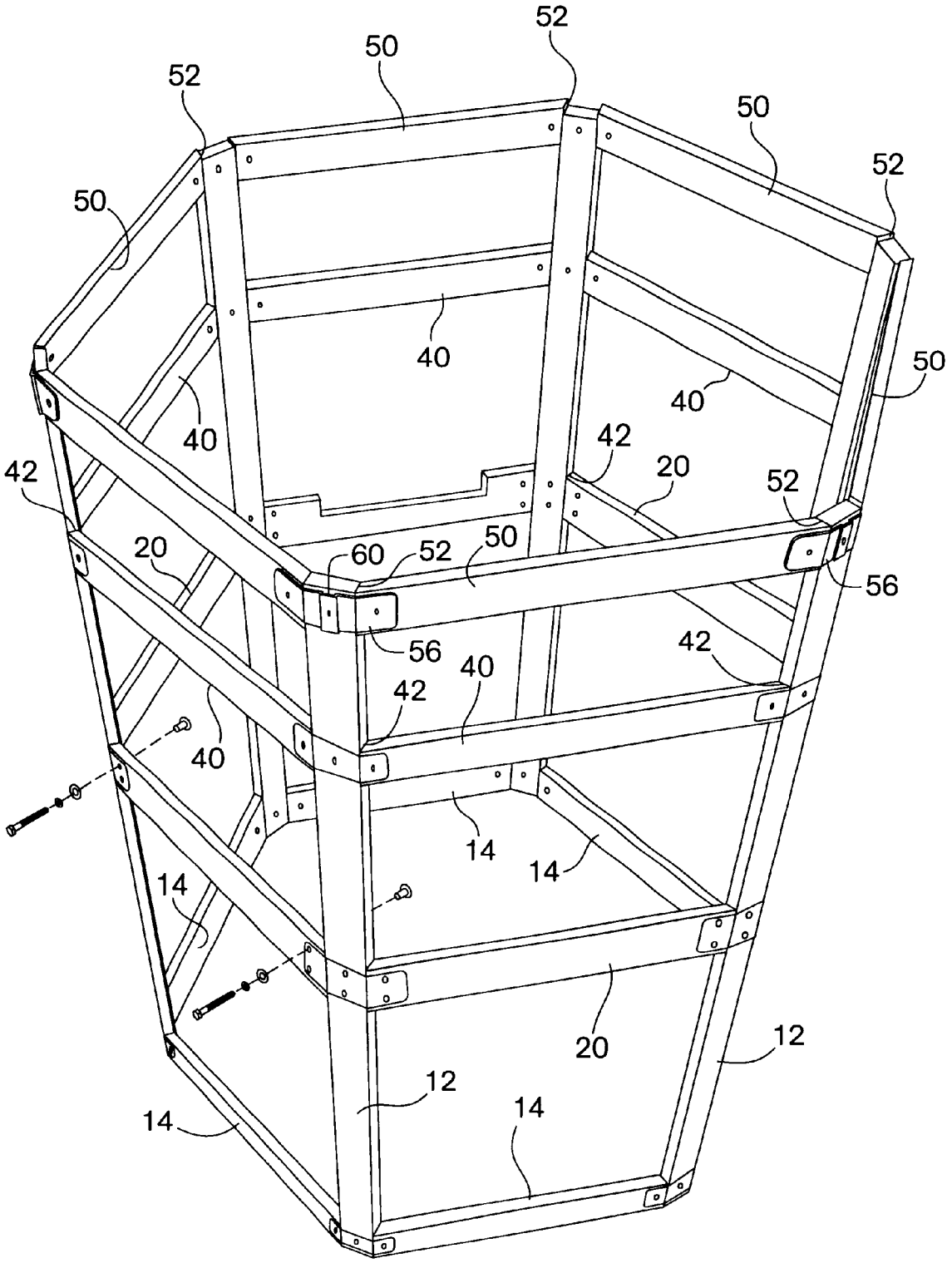
FIG. 4 is a perspective view of the side supports and side rails assembled theretogether.

Each bracket 24 is designed so as to be flush with the respective surface to which it attaches, so as not to leave any openings where a child might get hurt. Each bracket 24 comprises an elongated plate 26 having a first end 28 and a second end 30 and an intermediate portion 32, as best shown in FIG. 3. The first end 28 and the second end 30 are bent at an angle "B" of 30 degrees with respect to the plane of the intermediate portion 32.

An upper support beam 40 is arranged at an upper location between adjacent corner posts 12, each upper support beam 40 having a mitered cut 42 at their respective ends, so as to also present a flat face 44 against its respective mating surface 18 of the corner support post 12 to which it is attached. The upper support beams 40 are attached to the corner posts 12 by an angled bracket 24, in a manner similar to that of the aforementioned lower side support boards 20 and 14.

An uppermost side support board or rail 50 is attached to the uppermost portions of the corner posts 12, each uppermost support rail also having a 30 degree mitered end 52 thereon, so as to provide a flush pre-cut mitered surface to mate flat with the surface 18 of the uppermost end of the corner post 12. An uppermost brace or bracket 56 is arranged at the uppermost end of each corner post 12, to secure the mitered ends 52 of the uppermost wall supports or rails 50 to that respective corner post 12, as may be seen in FIGS. 1–6.

By virtue of having the side support boards or rails 14, 20, 40 and 50 factory pre-cut or mitered in this kit, permits this hexagonal shaped playset tower construction to be assembled much faster and in a safer manner for the children for whom it is intended than that shown in the tower playset prior art. The unique and critical combination of the mitered beams mated by the angled braces or brackets 24 and 56 so as to have their surfaces flush with the surfaces of the support posts 12 used for constructing this child's playset tower in a safe configuration thus avoids openings for places where little childrens' fingers or items of clothing or hair could be caught, likely resulting in injury to that child.

Figure 5:
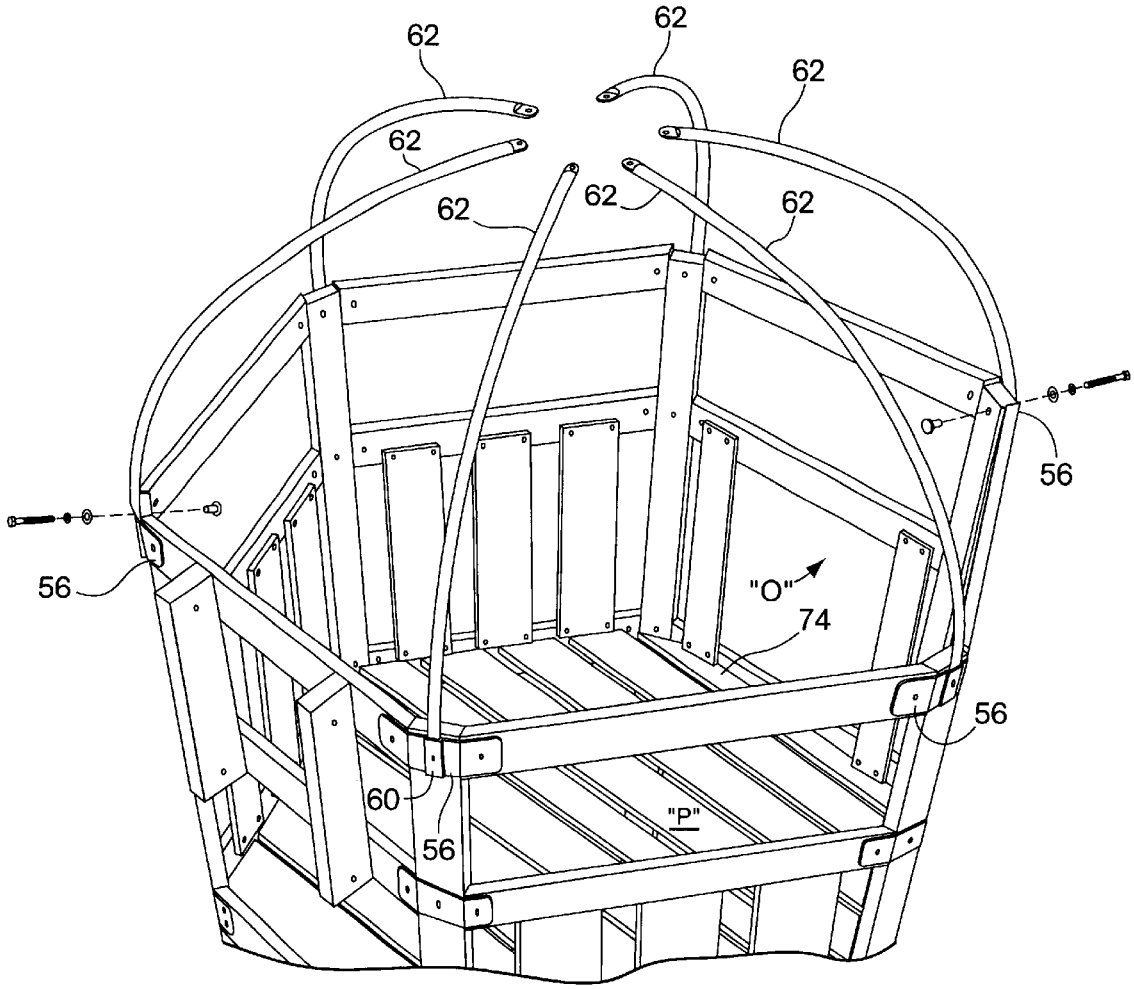
FIG. 5 is a perspective view of the upper end of the play set tower showing a curved tent pole arrangement thereon.
Figure 6:
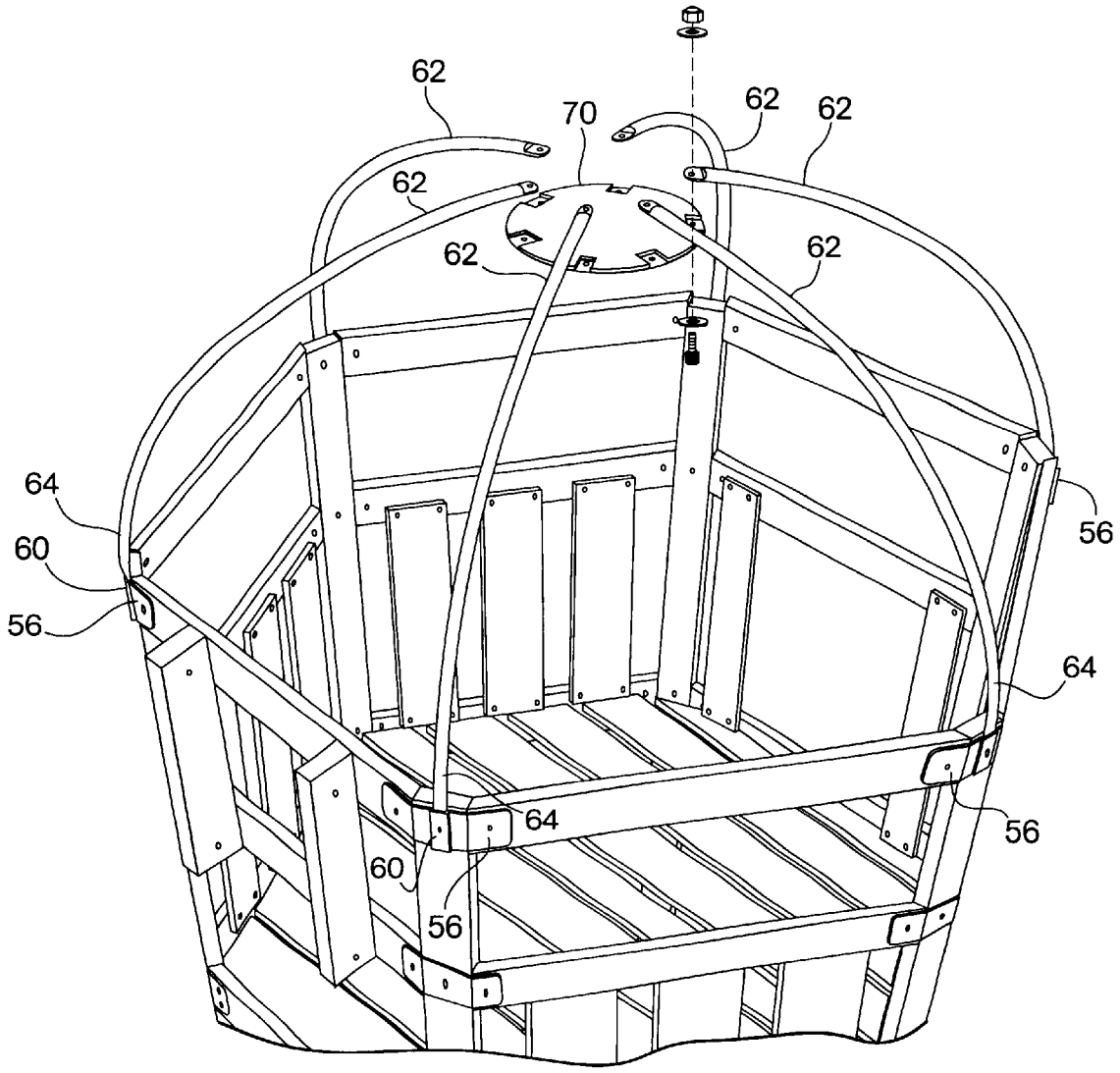
FIG. 6 is a view similar to FIG. 5 showing the curved tent poles secured theretogether.

The top angled brace or bracket 56 as an intermediate portion 58 with an outwardly directed 60 pocket thereon, as may be seen in FIGS. 3 and 6. A curved tent pole 62, as shown in FIGS. 5 and 6, extends to arc of about 90 degrees, and has a lowermost end 64 which mates within that pocket 60 of the top angled brace 56. The curved tent pole 62 is placed in each pocket 60 at each top brace 56 at each upper end of the respective corner posts 12, as shown in FIGS. 5 and 6. Each curved tent pole 62 has an uppermost end 66 which is attachable to a tent top plate 70, as shown in FIG. 6. The curved tent poles 62, once attached to one another through the tent top plate 70, comprise the ribs for a hexagon canvas tent 72 to be snugly and securely placed thereover.

A plurality of floor slats 74 are arranged across the intermediate side supports 20, and a plurality of side wall members 76 are secured between the intermediate wall supports 20 and the upper wall supports 40. The child's play area "P" is entered through a wall opening "O" between adjacent corner posts 12 above the intermediate side support boards or beams 20, as may be seen in FIG. 5. A ladder 78 is typically used to gain entry through that side opening "O" therein, as shown in FIG. 1.

Thus, what has been shown is a unique playset tower assembly, some 4 to 8 feet in height, and which comes in kit form, having a unique and critically important composition of pre-mitered components and correspondingly angled brackets to minimize areas such as small "openings" between components which are likely locations of injury to children, and to facilitate ease of construction of a hexagonally shaped base playset tower assembly.

What is claimed is:

1. A playset tower assembly for young children to climb upon and in, while minimizing potential areas of injury and maximizing structural stability, comprising:

an array of six corner posts having an upper and a lower end, and front and side facing surfaces;

an arrangement of lower, intermediate and upper side beams, each of said beams having ends with mitered surfaces thereon to flushly engage their respective side facing surfaces of said six corner posts; and an arrangement of angled brackets for flushly securing said beams to said six corner posts, said brackets correspondingly angled to minimize any spaced between said beams and said corner posts.

2. The playset tower assembly as recited in claim 1, wherein said side beams are mitered at an angle of thirty degrees to as to provide a flush mating surface between said side beams and said side facing surfaces of said six corner posts.

3. The playset tower assembly as recited in claim 2 wherein said side brackets have side portions and an intermediate portion which are formed at an angle of thirty degrees with respect to one another.

4. The playset tower assembly as recited in claim 2, wherein said tower assemble includes an uppermost beam arranged between the uppermost ends of said six corner posts and attached thereto by a top bracket, said top bracket having an enlarged receiving pocket thereon, for securement of a top arrangement to said assembly.

5. The playset tower assembly as recited in claim 4, wherein said top arrangement includes a plurality of curved tent poles.

6. The playset tower assembly as recited in claim 5, wherein said curved tent poles have a lower end which mate with said receiving pockets in said side brackets.

7. The playset tower assembly as recited in claim 4, wherein said curved tent poles have an upper end which attaches with a tent plate for stability of said poles.

8. The playset tower assembly as recited in claim 7, including a tent arranged over said tent poles, to provide a safe enclosure for young children playing within said tower assembly.

9. The playset tower assembly as recited in claim 8, wherein said beams, said six corner posts, said brackets, said curved poles and said tent are comprised of a kit defined by a completed tower assembly.

10. The playset tower assembly as recited in claim 8, wherein said assembly comprises a structure of between 4 and 8 feet in height.

11. A method of constructing a playset tower assembly for the safe use of young children, comprising the steps of:

arranging a vertical array of six corner posts in a hexagonal pattern, said posts having an upper and a lower end, and front and side facing surfaces;

providing an arrangement of lower, intermediate and upper side beams between adjacent corner posts, each of said beams having ends with mitered surfaces thereon to flushly engage their respective side facing surfaces of said six corner posts; and securing an arrangement of angled brackets to said beams and to said six corner posts, said brackets angled to minimize any spaced between said beams and said corner posts for safety of any children playing within said assembly.

12. The method of constructing a playset tower assembly for the safe use of young children as recited in claim 11, comprising the steps of:

mitering said beams at an angle of thirty degrees to as to provide a flush mating surface between said side beams and said side facing surfaces of said six corner posts.

13. The method of constructing a playset tower assembly for the safe use of young children as recited in claim 12, comprising the step of:

arranging a plurality of curved tent poles on said upper end of said corner posts.

14. The method of constructing a playset tower assembly as recited in claim 13, including the step of:

mating a lower end of said curved tent in a receiving pocket in said side brackets on said upper end of said corner posts.

15. The method of constructing a playset tower assembly as recited in claim 14, including the step of:

securing an upper end of said tent poled to a tent plate for stability of said poles.

16. The method of constructing a playset tower assembly as recited in claim 15, including the step of:

placing a tent arranged over said tent poles, to provide a safe enclosure for young children playing within said tower assembly.

17. A playset tower assembly for young children to climb upon and in, while minimizing potential areas of injury and maximizing structural stability, comprising:

an array of six corner posts having an upper and a lower end, and front and side facing surfaces;

an arrangement of lower, intermediate and upper side beams, each of said beams having ends with mitered surfaces thereon to flushly engage their respective side facing surfaces of said six corner posts;

an arrangement of angled brackets for securing said beams to said six corner posts, said brackets angled to minimize any spaced between said beams and said corner posts;

said side beams being mitered at an angle of thirty degrees to as to provide a flush mating surface between said side beams and said side facing surfaces of said six corner posts;

said side brackets have side portions and an intermediate portion which are formed at an angle of thirty degrees with respect to one another; an uppermost beam arranged between the uppermost ends of said six corner posts and attached thereto by a top bracket, said top bracket having an enlarged receiving pocket thereon, for securement of a top arrangement to said assembly, and wherein said top arrangement includes a plurality of curved tent poles, said curved tent poles having a lower end which mate with said receiving pockets in said side brackets, wherein said curved tent poles have an upper end which attaches with a tent plate for stability of said poles, and a tent arranged over said tent poles, to provide a safe enclosure for young children playing within said tower assembly.

18. The playset tower assembly as recited in claim 17, wherein said beams, said six corner posts, said brackets, said curved poles and said tent are comprised of a kit defined by a completed tower assembly.

* * * * *